US006264517B1

(12) United States Patent
Limoli et al.

(10) Patent No.: US 6,264,517 B1
(45) Date of Patent: Jul. 24, 2001

(54) MARINE INBOARD WINTERIZING CIRCULATING SYSTEM

(76) Inventors: Frank M. Limoli, 20 Trafton Rd., Framingham, MA (US) 01701; Thomas Lamoly, 34 Cornell St., Danvers, MA (US) 01923; John E. Sergi, 104 Woodside Rd., Franklin, MA (US) 02038

( * ) Notice: Subject to any disclaimer, the term of this patent is extended or adjusted under 35 U.S.C. 154(b) by 0 days.

(21) Appl. No.: 09/294,649

(22) Filed: Apr. 19, 1999

(51) Int. Cl.[7] ..... B63H 21/10
(52) U.S. Cl. ..... 440/88; 440/113
(58) Field of Search ..... 440/88, 113; 137/167 R, 137/169 R; 114/197, 221 R; 141/98; 134/167 R

(56) References Cited

U.S. PATENT DOCUMENTS

| | | | | |
|---|---|---|---|---|
| 3,931,828 | * | 1/1976 | Lawler | 134/167 R |
| 4,246,863 | * | 1/1981 | Reese | 440/88 |
| 4,359,063 | * | 11/1982 | Carlson | 440/113 |
| 4,619,618 | * | 10/1986 | Patti | 440/88 |
| 4,973,276 | * | 11/1990 | Mavrelis | 440/113 |
| 5,035,208 | | 7/1991 | Culp . | |
| 5,036,675 | * | 8/1991 | Anderson, Jr. | 62/85 |
| 5,071,377 | | 12/1991 | Saunders et al. . | |
| 5,137,482 | | 8/1992 | Hull et al. . | |
| 5,337,774 | * | 8/1994 | Boyd | 440/88 |
| 5,362,265 | | 11/1994 | Gervais . | |
| 5,482,483 | * | 1/1996 | Rice | 440/88 |
| 5,549,494 | | 8/1996 | Fosmer . | |
| 5,579,727 | * | 12/1996 | Logan et al. | 440/88 |
| 5,664,526 | * | 9/1997 | Logan et al. | 440/88 |
| 5,746,629 | * | 5/1998 | Smith | 440/88 |
| 5,823,836 | * | 10/1998 | Anderson | 440/88 |
| 5,845,684 | * | 12/1998 | Flectcher, Jr. et al. | 141/98 |
| 5,902,159 | * | 5/1999 | Killpack et al. | 440/88 |
| 5,934,957 | * | 8/1999 | Sato et al. | 440/88 |

* cited by examiner

*Primary Examiner*—S. Joseph Morano
*Assistant Examiner*—Lars A. Olson
(74) *Attorney, Agent, or Firm*—Samuels, Gauthier & Stevens

(57) ABSTRACT

A device and method that simplifies marine maintenance for inboard motorboats. The device and method allows an individual to safely flush the engine of a motorboat while the boat is out of the water by simulating the fluid circulation conditions of a boat in the water. More specifically, the device and method eliminates the danger of damaging the boat's engine on account of excessive fluid flow through the engine by utilizing the boat's coolant pump propulsion system to pull precise amounts of fluid through the system at appropriate flow rates and pressure levels.

17 Claims, 6 Drawing Sheets

MARINE INBOARD WINTERIZING CIRCULATING SYSTEM

BACKGROUND OF THE INVENTION

1. Field of the Invention

The present invention relates to a device and method that simplifies marine maintenance required for inboard motorboats. More particularly, the invention relates to a device and method for flushing the engine of a motorboat while the boat is out of the water. The device simulates the cooling water circulation conditions of a boat in the water and allows the operator to safely run the propulsion units for service and maintenance. The device utilizes a boat's coolant pump propulsion system to circulate fluids through the boat engine at proper flow rates and at acceptable pressure levels. A pressure release means within the device provides a further step to ensure that the pressure within the engine does not reach critical levels, which would cause engine damage. The invention operates in a variety of climates, however it is particularly useful in below freezing climates where winterization is crucial and necessary.

2. Background Art

Internal cleaning of a boat'inboard marine engine is imperative to extending the life the engine. Depending upon an individual's use of the boat, the engine may contain saltwater, sand, mud, alkalis and other debris that will corrode the engine if they are not properly removed. Typically, a cleaning process involves forcing clean or fresh water through the engine to flush out the saltwater and debris. This is accomplished by introducing a stream of water into the sea water inlet, which is in fluid connection with the boat's internal engine.

There are a number of different approaches to flushing fresh or clean water through an inboard motorboat engine when the boat is removed from the water. Some examples of such devices are U.S. Pat. No. 5,035,208 to Culp, U.S. Pat. No. 5,071,377 to Saunders et al., U.S. Pat. No. 5,137,482 to Hull et al., U.S. Pat. No. 5,362,265 to Gervais and U.S. Pat. No. 5,549,494 to Fosmer.

Culp describes a "Y" valve that is attached and accessed inside the engine compartment. Flushing fluid is propelled through the engine by either water pressure or gravity. Such a system is inconveniently located and the pressure forcing fluids through the engine by such means is often either insufficient or excessive.

Saunders describes a conical member having a bendable double lip for handling attachment to different hull angles, and a T-shaped water supply conduit in connection with a water hose. The device has a height adjustable ground engaging tube that supports the device against a boat's hull. Water is forced through the engine by use of a pressurized water source. Such a system may lead to excessive pressure within the engine.

Hull describes a suction cup adapted to cover the intake port of a boat, a locking height adjustable handle that holds the suction cup against the port, and a conduit providing fluid connection between a water hose and the suction cup. Water is forced through the engine by use of a pressurized water source. Like the Saunders' device, pressure within the engine may reach excessive levels.

Fosmer describes a device that holds a pressurized water source to a boat's cooling water inlet in water tight contact. Like Saunders and Hull, pressure levels are not kept under control with such a system.

Gervais describes a conduit between a boat engine and a fluid supply. Cleansing fluid is supplied by a pressurized water source. A valve in the device controls the flow of water through the engine. A manual switch assembly of the device controls the valve and the starting of the boat's engine. While such a device includes a pressure lowering means, the system is complex and is subject to human error.

Thus, while these devices provide means of flushing the engine of a boat while the boat is out of the water, none of these devices adequately protects a boat's coolant circulation system during the process. Each device relies upon a pressurized water source to force water through the boat engine. However, if water pressure is not controlled and increases to excessive levels, the engine may be damaged. Internal damage and leaks become serious concerns, for example, if pressure levels exceed 20–30 psi. As stated above, Gervais addresses this pressure problem by use of a solenoid switched valve. However, such a device is complex and requires manual adjustment of the switch assembly to open and close the valve as one sees fit. Thus, human error becomes a problem if an individual makes mistakes, forgets, or improperly monitors and adjusts the valve. Hence, what is needed is a simple engine flushing device that is capable of self-adjusting to maintain a proper fluid flow and appropriate operating pressure.

SUMMARY OF THE INVENTION

An object of the present invention is to provide a simple marine engine flushing device that safely and quickly cleans all coolant propulsion systems of inboard motorboats, while the boats are out of the water. The device further allows an individual to safely run a motorboat engine out of the water, for example, while the boat is in storage or on dry dock.

A further object of this invention is to provide a device that may be used on a broad spectrum of water inlet openings, located on the hull surfaces of inboard motorboats, by use of an adapter.

A further object of this invention is to provide a device that will efficiently circulate anti-freeze or other fluid from an elevation lower than the inlet opening for total fluid occupation. Another aspect of this invention allows an individual to observe the flow of fluid through the engine to confirm proper fluid circulation.

A further object of this invention is to eliminate the danger of damaging a boat engine by excessive fluid flow during engine flushing by utilizing the force of a boat's coolant pump propulsion system to convey a precise amount of fluid in through the system. At the same time, the need to enter tightly quartered engine compartments during flushing and priming procedures is eliminated.

A further object of this invention is to provide an additional safeguard to avoid excessive pressure build-up within an engine by providing a pressure relief means.

A further object of this invention is to provide a means for priming other accessory pumps of an inboard motorboat.

A further objective is to provide a device that is easily and inexpensively manufactured.

Other aspects of the invention are disclosed infra.

DETAILED DESCRIPTION OF THE INVENTION

Figure 1:
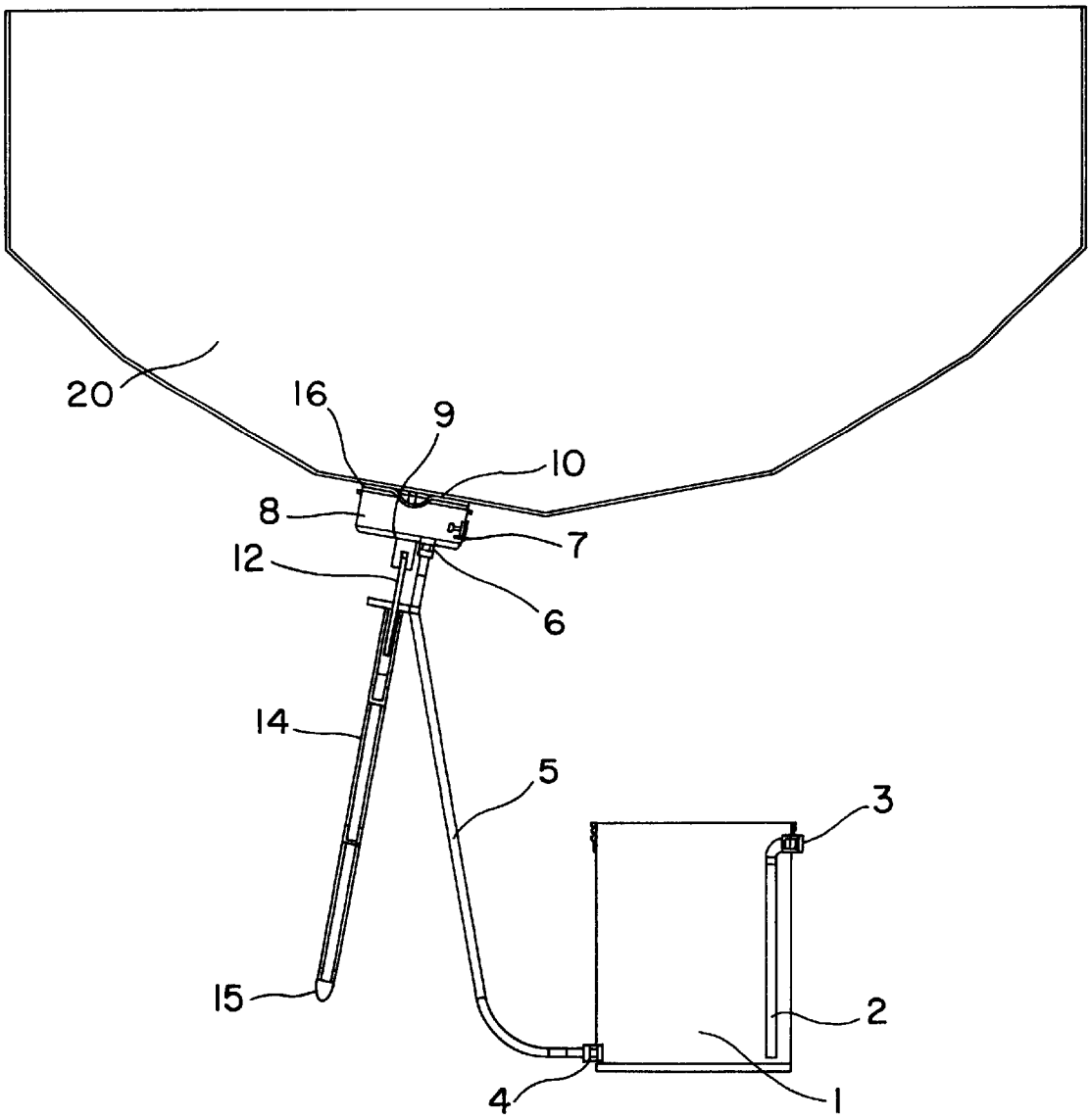
FIG. 1 illustrates a plan view of the device fixed to the hull of an inboard motorboat in accordance with one embodiment of the present invention.
Figure 2:
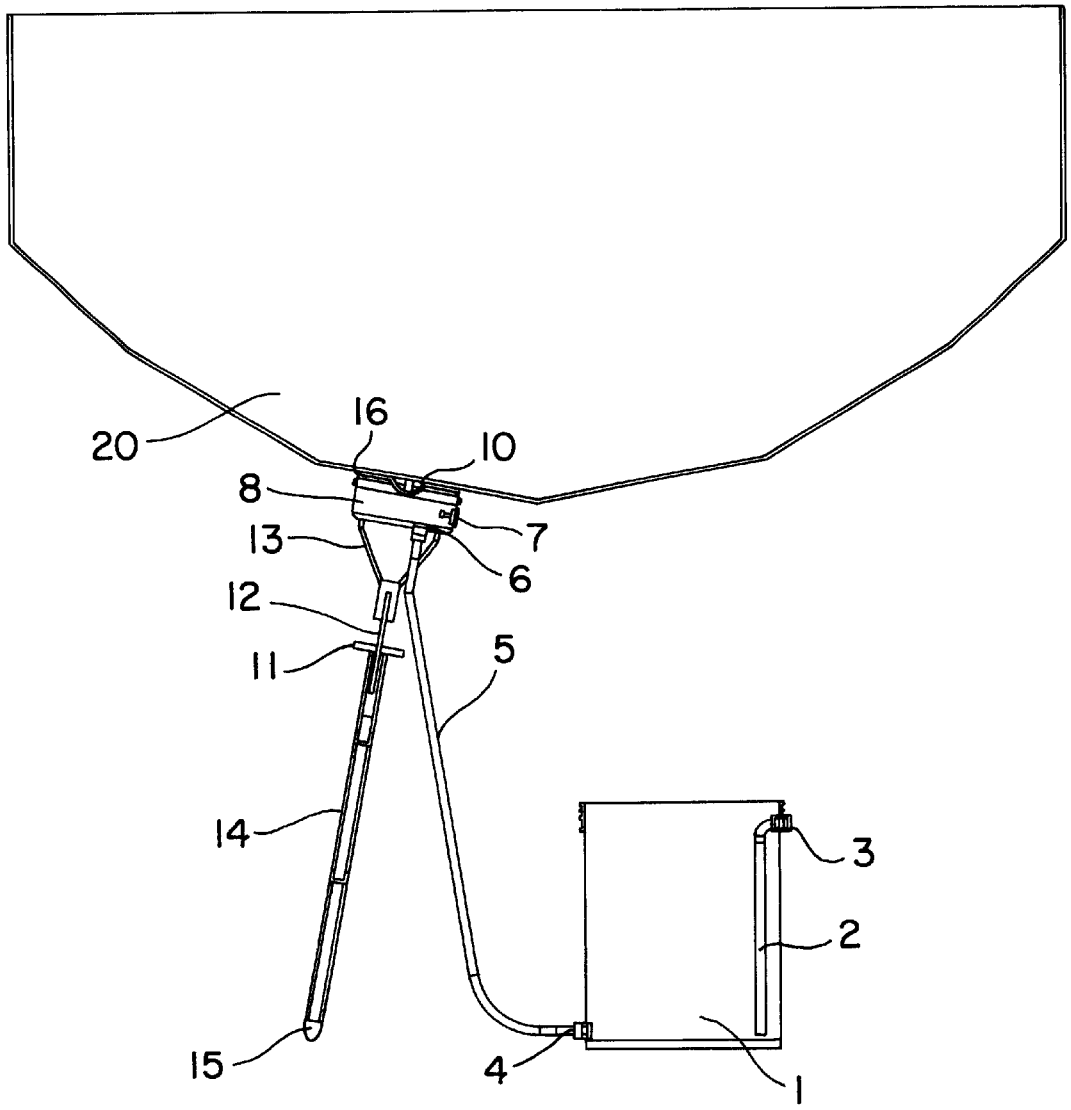
FIG. 2 illustrates a plan view of the device fixed to the hull of an inboard motorboat in accordance with a second embodiment of the present invention.
Figure 3:
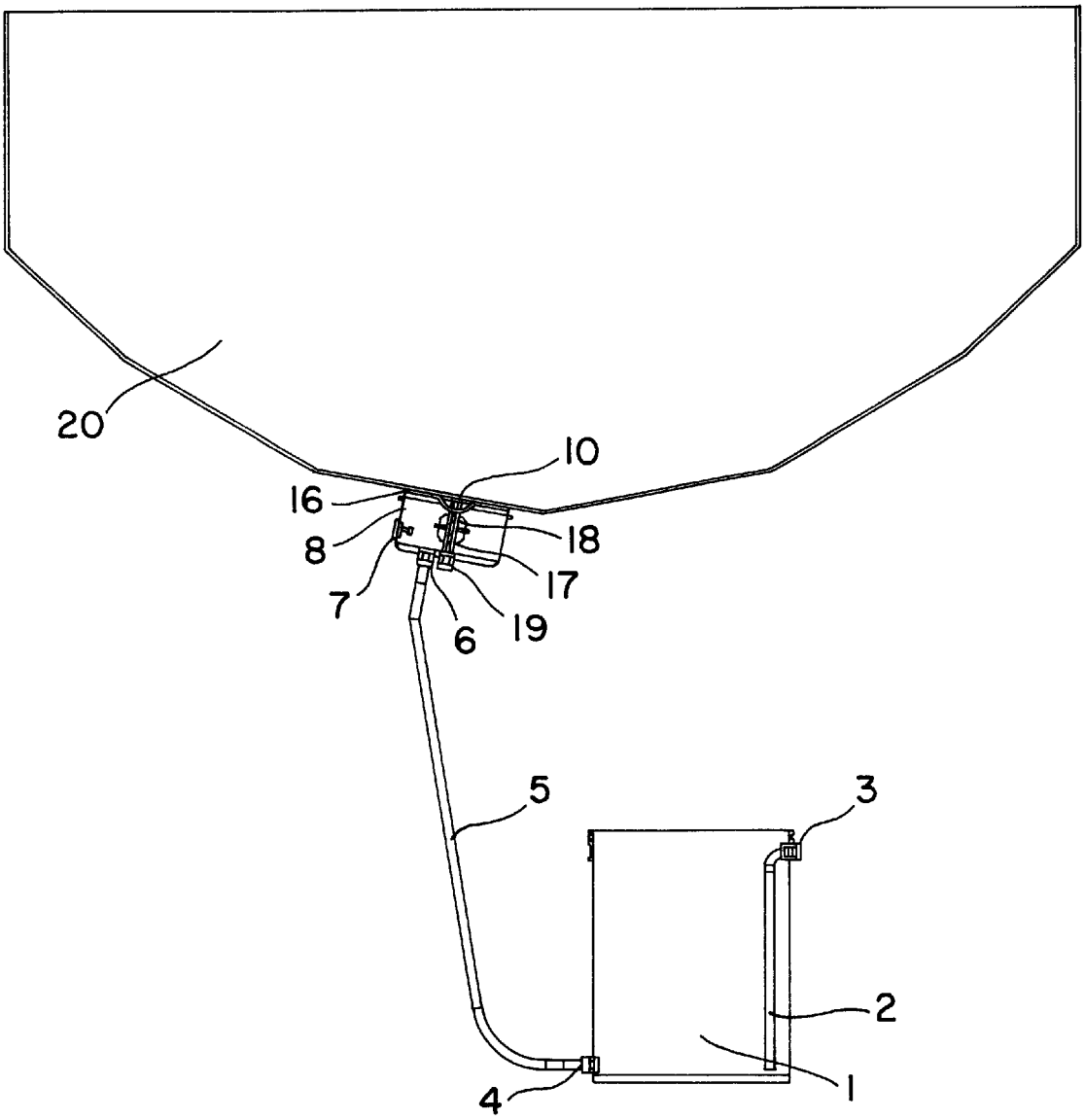
FIG. 3 illustrates a plan view of the device with adapter fixed to the hull of an inboard motorboat in accordance with a third embodiment of the present invention.
Figure 4:
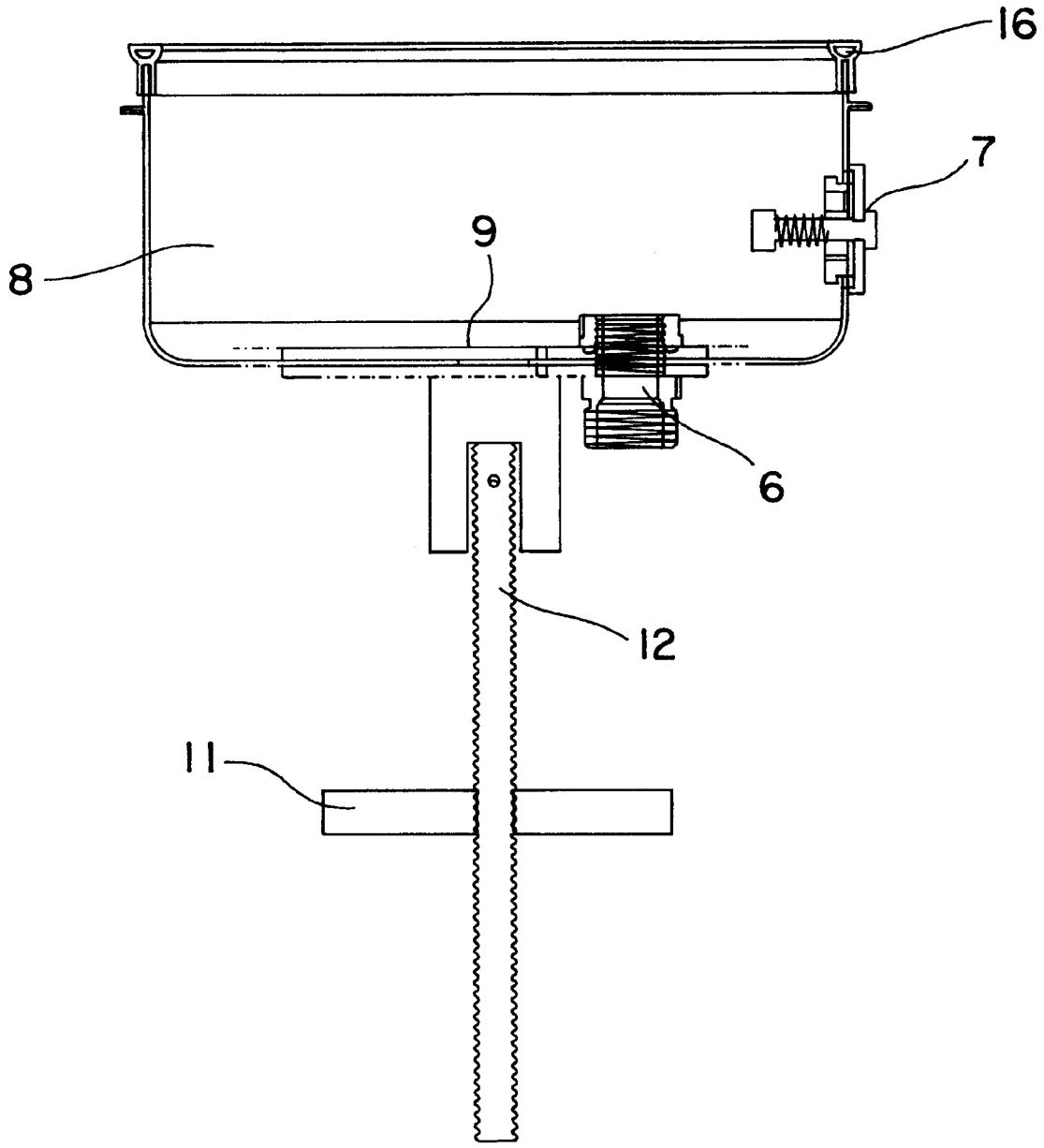
FIG. 4 illustrates a blown-up side view of the device as shown in FIG. 1.
Figure 5:
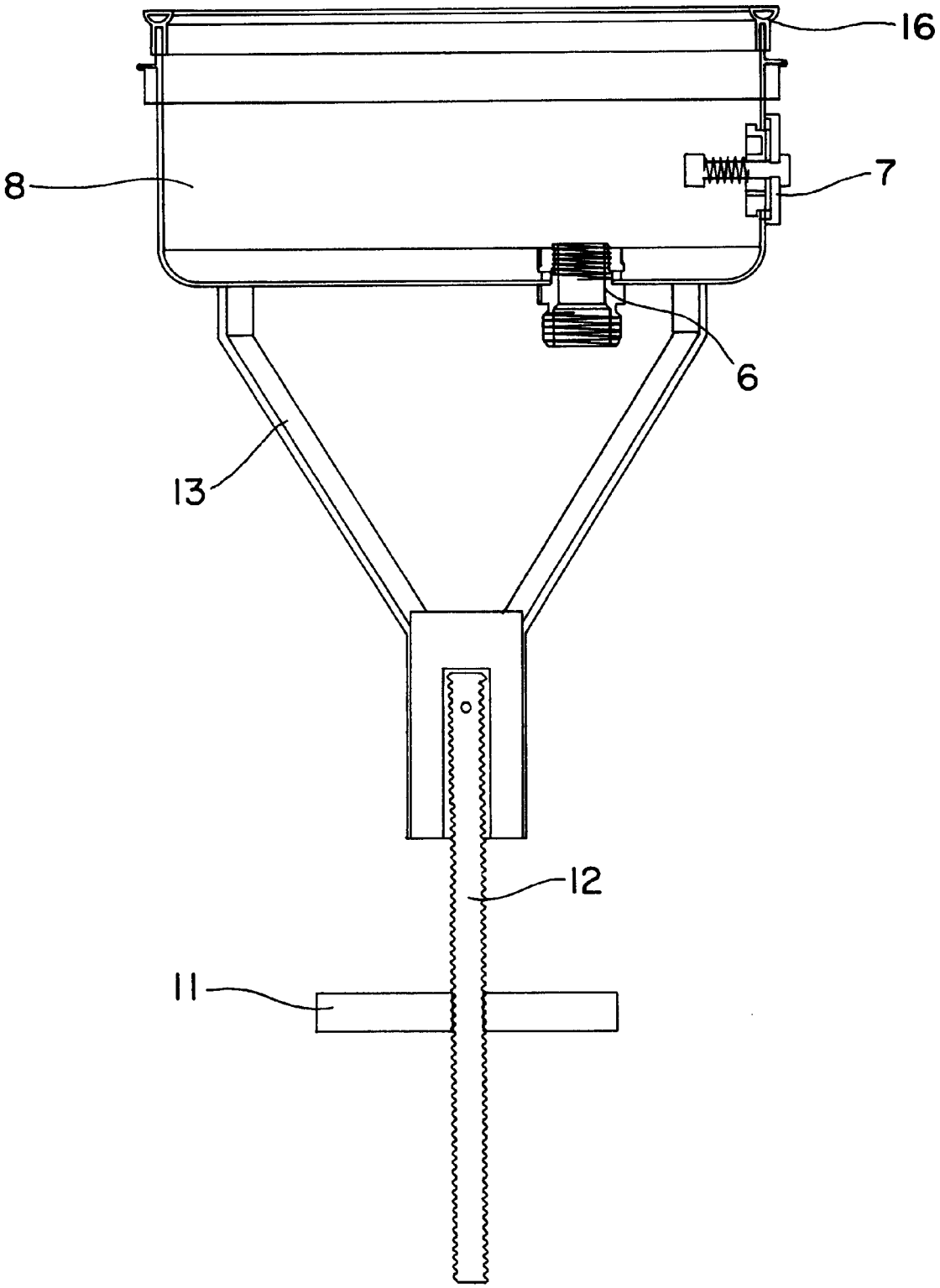
FIG. 5 illustrates a blown-up side view of the device as shown in FIG. 2.
Figure 6:
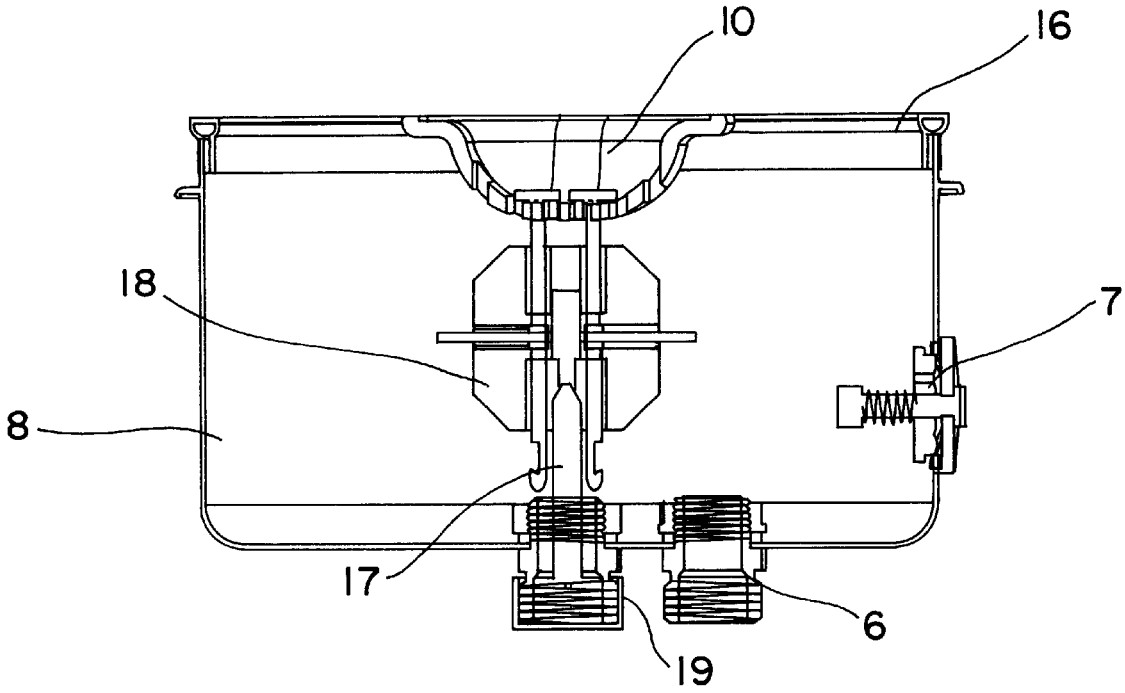
FIG. 6 illustrates a blown-up side view of the device as shown in FIG. 3.

FIGS. 1–3 illustrate the device attached to the hull of an inboard motorboat in accordance with three embodiments of the present invention. FIGS. 4–6 show blown-up views of the device shown in FIGS. 1–3 respectively. The overall device shown in these figures vary in their means of attachment to the boat.

As shown in FIGS. 1–3, a water source, such as a garden hose, is attached to a reservoir container 1. Water is pumped from the water source and into the reservoir container 1, which stores the water in the system. A measurement splash tube 2 is located in the reservoir container 1 so that water levels and flow may be easily monitored. In fluid connection with the reservoir container 1 is a conduit 5. The conduit is preferably a clear reinforced hose that allows an individual to observe and confirm proper fluid circulation through the engine. The conduit 5 connects the reservoir container 1 to a cover 8, which is mounted over the fluid inlet 10 on the hull 20 of an inboard motorboat.

The cover 8 is adapted to provide a suction seal around the fluid inlet 10 that is necessary for the propulsion pump of an inboard motorboat to pull fluid from the reservoir container 1 and into the engine. This use of the engine's own propulsion system in connection with a reservoir container 1 effectively prevents excessive fluid flow and excessive pressure within the engine by allowing the boat's own propulsion system to control the amount of fluid and the pressure by which the fluid is pumped into the engine. Thus, the engine's propulsion system operates to pull fluids into the engine rather than allowing an external source to push the fluid in, thereby eliminating the danger of damage to the engine during a flushing process resulting from use of an independent pressurized water source.

The suction seal around the fluid inlet 10 may be accomplished by, for example, providing a cover 8 that has an extruded perimeter with a fused gasket 16 at the top, for surrounding fluid inlet 10. The gasket 16 may, for example, be a neoprene gasket, which comes in a roll and has a slot along its length. Such a gasket 16 is attached to the cover 8 with the slot that fits on the cover perimeter. However, any other means of attaching the cover 8 so as to provide a suction seal around the fluid inlet 10, thereby allowing water entering the reservoir container 1 to be pumped through the conduit 5, into the cover 8, into the fluid inlet 10 and through the engine, may be used.

The cover 8 is preferably clear, so that an individual may monitor fluid flow into the fluid inlet 10 of a boat. To accommodate the large volumes of fluid flow into and out of the cover 8, the cover 8 must be fabricated of a strong, leak-proof material. Most preferably, the cover 8 is fabricated of transparent thermoplastic.

Within the cover 8 is a pressure relief means 7, such as a pressure relief blow-off valve. The pressure relief means 7 automatically operates to lower the pressure within the system when the pressure approaches maximum safe operating levels. Such a pressure relief means 7 may be, for example, a spring loaded seal which spouts when the pressure reaches maximum levels.

The entire system is fluid tight to prevent leakage of water out of the system. Thus, connecting means between (a) the water source and reservoir container 1, (b) the reservoir container 1 and the conduit 5, and (c) the conduit 5 and the cover 8, must be fluid tight. Such fluid tight connections may be accomplished by, for example, sealed male and female garden hose inlets and outlets. In the preferred embodiment, as illustrated in the figures, a sealed female garden hose inlet 3 connects the water source to the reservoir container 1, a sealed male garden hose outlet 4 connects the reservoir container 1 to the conduit 5, and a sealed male garden hose inlet 6 connects the conduit 5 to the cover 8.

As shown in FIGS. 1 and 2, the device is supported against the hull 20 of a boat by poles 14 extending from the cover 8 to the ground. Preferably the poles 14 are height adjustable, and may be, for example, interlocking extension poles. A grounding point 15 such as a rubberized tip or a spike may be located at the end of the poles to prevent the poles 14 from slipping on the ground and to sturdily hold the cover 8 against the hull 20 of a boat.

In one embodiment shown in FIGS. 1 and 4, the cover 8 is mounted on the hull 20 of the boat using a double sealed flange plate with fastened sleeve 9, a pinned threaded stud 12, a drive nut 11, interlocking extension poles 14, and a grounding point 15.

In a second embodiment shown in FIGS. 2 and 5, the device is mounted on the boat using a welded metallic cover bracket 13, a pinned threaded stud 12, a drive nut 11, interlocking extension poles 14, and a grounding point 15.

In a third embodiment shown in FIGS. 3 and 6, an adapter 18 engages and locks directly to fluid inlet 10. Inlet engaging means 21 lock onto and secure the cover to the fluid inlet 10. Appropriate inlet engaging means 21 include hooks and elongate members having outward projections at their tops, for example an upside-down L-shape, which would extend into the fluid inlet 10 and latch onto the surface around the fluid inlet 10 as shown in FIG. 6. An adapter stud 17 and a sealed fitting cap 19 further secure the adapter 18 to the cover 8. Use of the adapter 18 allows the device to independently adjust to the broad spectrum of coolant intake openings found in main engines, air conditioning units, and generator units, which are on the boat hull surface 20.

Although a preferred embodiment of the invention has been described using specific terms, such description is for illustrative purposes only, and it is to be understood that changes and variations may be made without departing from the spirit or scope of the following claims.

What is claimed is:

1. A device for winterizing inboard motorboat engines comprising:

a cover structured to surround a fluid inlet on the hull of an inboard motorboat, forming a suction seal around the fluid inlet, said cover having means for automatic pressure relief;

a conduit extending from the cover and in fluid communication with the cover;

a reservoir container, for holding fluid, in fluid communication with the conduit;

the cover, conduit and reservoir container connected with fluid tight fastening means;

a coolant pump propulsion system in communication with the motor boat engine.

2. The device of claim 1 wherein the means for automatic pressure relief is a spring loaded seal.

3. The device of claim 1 wherein the means for automatic pressure relief is a pressure release blow-off valve that automatically spouts when pressure reaches 20 psi.

4. The device of claim 1 wherein the cover has an extruded perimeter with a fused gasket for forming a suction seal around the water inlet.

5. The device of claim 1 wherein the conduit is a clear reinforced hose through which fluid flow is visible.

6. The device of claim 1 wherein the cover is fabricated of a strong, leak-proof transparent material.

7. The device of claim 6 wherein the cover is fabricated of transparent thermoplastic.

8. The device of claim 1 further including a measurement splash tube within the reservoir container for monitoring fluid levels within the reservoir container.

9. The device of claim 1 wherein the means for fluid tight fastening are male and female garden hose inlets and outlets.

10. The device of claim 1 further including at least one pole, having ground engaging means, extending from the cover and supporting the cover around the fluid inlet.

11. The device of claim 10 comprising a plurality of poles, which poles are height adjustable.

12. The device of claim 11 wherein the poles are interlocking extension poles.

13. The device of claim 10 wherein the poles are attached to the cover by a sealed flange plate with fastened sleeve, at least one threaded stud and at least one nut.

14. The device of claim 13 further comprising an adapter for allowing use of the device on a variety of inlet openings on motorboats.

15. The device of claim 14 wherein the adapter locks onto the inlet with inlet engaging means.

16. The device of claim 15 wherein the adapter is further locked to the inlet by an adapter stud and fitting cap.

17. The device of claim 10 wherein the poles are attached to the cover by at least one bracket, at least one threaded stud and at least one nut, whereby the bracket attaches the cover to the threaded stud and nut, and the threaded stud and nut attach the bracket to the poles.

* * * * *